United States Patent [19]

Asao et al.

[11] 4,370,954

[45] Feb. 1, 1983

[54] APPARATUS FOR STARTING INTERNAL COMBUSTION ENGINE

[75] Inventors: Tomohiro Asao; Yosuke Takahashi, both of Osaka, Japan

[73] Assignee: Yanmar Diesel Engine Co., Ltd., Osaka, Japan

[21] Appl. No.: 148,229

[22] Filed: May 9, 1980

[30] Foreign Application Priority Data

Aug. 14, 1979 [JP] Japan ..... 54-111730[U]

[51] Int. Cl.[3] ..... F01L 13/08; F02N 3/02

[52] U.S. Cl. ..... 123/182; 123/185 B

[58] Field of Search ..... 123/182, 185 A, 185 B, 123/185 BA, 150, 90.16

[56] References Cited

U.S. PATENT DOCUMENTS

| | | | |
|---|---|---|---|
| 1,171,170 | 2/1916 | Casgrain | 123/185 B |
| 2,023,048 | 12/1935 | Gentili | 123/90.16 |
| 2,648,321 | 8/1953 | Slonneger | 123/182 |
| 2,741,235 | 4/1956 | Vieceli | 123/185 BA |
| 2,758,580 | 8/1956 | Balzer | 123/182 |
| 3,212,487 | 10/1965 | Johnson | 123/185 A |
| 3,730,162 | 5/1973 | Murase | 123/185 BA |

*Primary Examiner*—Charles J. Myhre
*Assistant Examiner*—Andrew M. Dolinar
*Attorney, Agent, or Firm*—Armstrong, Nikaido, Marmelstein & Kubovcik

[57] ABSTRACT

An apparatus for starting an internal combustion engine which comprises: a rope starting device including a rope provided with a knob, a reel around which the rope is wound and a clutch adapted to transmit the rotation of the reel to an engine crank shaft; and a decompression device including a cam adapted to forcibly open an exhaust valve by pushing one end of a valve lever associated with the exhaust valve and a shaft on which said cam is fixed to be biased resiliently and rotatively in one direction, the pushing amount of the end of the valve lever by the cam being set to be smaller than the pushing amount of the same effected by a push rod of a valve actuating mechanism for the exhaust valve. When the end of the valve lever is pushed by the cam, the cam engages the valve lever while keeping the exhaust valve in the opened state, whereas when the push rod pushes the end of the valve lever, the cam is disengaged from the valve lever.

11 Claims, 21 Drawing Figures

APPARATUS FOR STARTING INTERNAL COMBUSTION ENGINE

BACKGROUND OF THE INVENTION

The present invention relates to an apparatus for starting an internal combustion engine and, more particularly, to an improvement in a rope starting apparatus for starting a small-sized internal combustion engine.

Generally, small-sized internal combustion engines are provided with manually operable starting apparatus such as recoil starter using a rope. This rope starting device has a reel around which is wound a rope. As the rope is pulled, the reel is rotated to impact a starting inertia to the engine crank shaft through a clutch, thereby to start the engine. In this starting operation by pulling the rope with hand for rotating the crank shaft, a large load is imposed during the compression stroke of the engine to hinder the rotation of the engine crank shaft.

In order to facilitate the rotation of the crank shaft during the starting, the exhaust valve of the engine is temporarily kept opened to keep the engine in the state of decompression and, when a sufficient inertia is obtained, the exhaust valve is released to take operative position to dismiss the state of decompression thereby to start the engine. This device for temporarily keeping the exhaust valve in the opened position is usually referred to as "decompression device".

In starting an engine provided with both of rope starting device and decompression device, it is necessary to manipulate both devices simultaneously. This inevitably requires two operators for the starting operation.

Another problem concerning the rope starting device is that a strong impact is imparted to the arm of the operator pulling the rope when the crank shaft of the engine rotates beyond the top dead center in the compression stroke. An extremely large impact is given to the operator's arm dangerously particularly when the engine has a large compression ratio.

SUMMARY OF THE INVENTION

It is, therefore, an object of the invention to provide a starting apparatus for internal combustion engine equipped with both of a recoil starting device and a decompression device, capable of being manipulated by only one operator.

It is another object of the invention to provide a starting apparatus of a safe starting apparatus for an internal combustion engine, which is designed and constructed to eliminate the impact given to the operator's arm during the pulling of the rope.

It is still another object of the invention to provide a starting apparatus for an internal combustion engine in which a knob attached to the rope of the rope starting device is improved to obviate the impact which is given to the operator's arm during the starting operation.

To these ends, according to the invention, there is provided an apparatus for starting an internal combustion engine comprising: a rope starting device including a rope provided with a knob, a reel around which the rope is wound and a clutch adapted to transmit the rotation of the reel to an engine cranks shaft; and a decompression device including a cam adapted to forcibly open an exhaust valve by pushing one end of a valve lever and a shaft on which the cam is fixed to be biased resiliently and rotatively in one direction, the amount of push of the end of the valve lever being set to be smaller than that provided by a push rod of the valve actuating mechanism.

The above and other objects, as well as advantageous features of the invention will become clear from the following description of the preferred embodiments taken in conjunction with the accompanying drawings.

DESCRIPTION OF PREFERRED EMBODIMENTS

Figure 1:
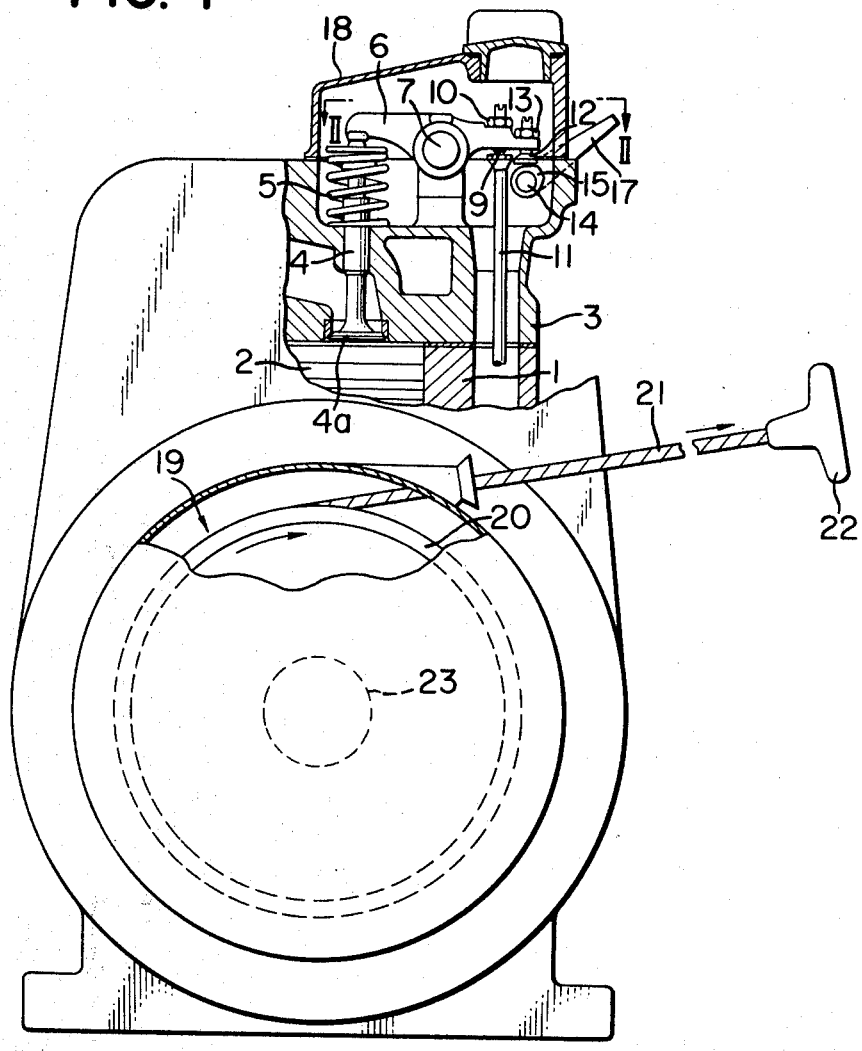
FIG. 1 is a partly sectioned side elevational view of a small-sized internal combustion engine provided with a starting apparatus embodying the present invention.
Figure 2:
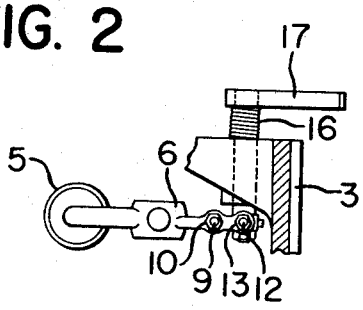
FIG. 2 is a sectional plan view taken along the line II—II of FIG. 1.

Referring to FIGS. 1 and 2, a reference numeral 1 denotes a cylinder accomodating a piston 2 adapted to make a reciprocating movement therein. A cylinder head attached to the top of the cylinder 1 is designated at a reference numeral 3. An exhaust valve 4 is mounted on the cylinder head 3. The exhaust valve 4 is resiliently biased by a spring 5 in such a direction that the valve head **4*a* thereof is kept in contact with a cooperating valve seat. A reference numeral 6 denotes a valve lever supported rockably around the axis of a fulcrum shaft 7 and having one end held in contact with the upper end of the stem of the exhaust valve 4. A seat 9 having an adjusting screw is fixed by a lock nut 10 to the other end of the valve lever 6. A push rod 11 makes a contact at its upper end with the seat 9**.

The push rod 11 is adapted to push the other end of the valve lever 6 through the seat 9 during the exhaust stroke of the engine. Since the valve lever 6 is rockably supported by the fulcrum shaft 7, the other end of the valve lever 6 depresses the top end of the stem of the exhaust valve 4 to forcibly open the exhaust valve 4 overcoming the force of the spring 5.

The other end of the valve lever 6 having the seat 9 is provided with another seat 12 attached thereto by means of a lock nut 13 at a position in the vicinity of the first-mentioned seat 9. The seat 12 also is provided with an adjusting screw making a screwing engagement with the lock nut 13, so that the amount of downward projection of the seat 12 is adjustable through rotation of the lock nut 13. A cam 15 fixed to a shaft 14 is disposed under the seat 12. The shaft 14 is rotatably mounted on the cylinder head 3 and is rotatively biased in the clockwise direction as shown in FIG. 1 by a spring 16 which has a spring force smaller than that of the valve spring 5 of the exhaust valve 4. The cam 15 can be operated externally by means of an operation lever 17 attached to the other end of the shaft 14.

Figure 3:
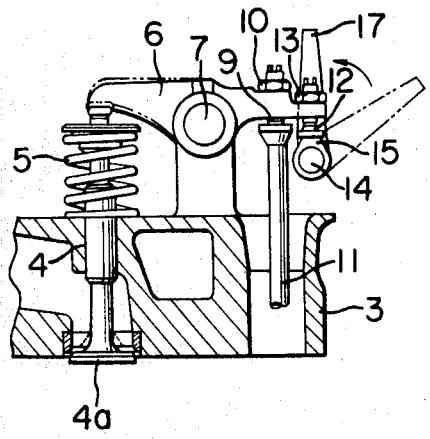
FIG. 3 is a vertical sectional view of the engine shown in FIG. 1 with its exhaust valve held in a decompression position.
Figure 4:
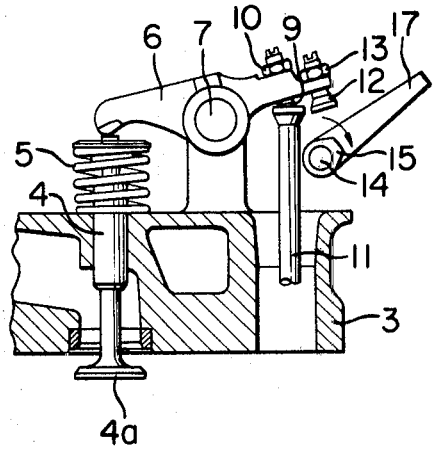
FIG. 4 is a vertical sectional view of the engine shown in FIG. 1 with the exhaust valve held in an exhausting position.

Therefore, as the operation lever 17 is rotated counter-clockwise from the position shown in FIG. 1 to the position shown in FIG. 3, the flat surface of the cam 15 pushes the seat 12 upward so that the exhaust valve 4 is slightly opened through the valve lever 6. The chamber in the cylinder 1 is kept in the state of decompression by this slight opening of the exhaust valve 4. The degree of decompression can be varied by changing the amount of downward projection of the seat 12 through an adjustment of the lock nut 13.

Anyway, it is essential in the present invention that the amount of push-up of the valve lever 6 by the cam 15 is smaller than that effected by the push rod 11.

The mutual engagement of the cam 15 and the valve lever 6 can be automatically dismissed when the cam 15 is separated from the seat 12 and rotated clockwise by the resilient biasing force of the spring 16, as the push rod 11 pushes the valve lever 6 in the exhaust stroke. Therefore, the exhaust valve 4 is kept closed when the push rod 11 is lowered for the next compression stroke so that the decompression does not take place. A reference numeral 18 denotes a cylinder head cover.

A reference numeral 19 generally denotes a recoil starter which is a typical example of a rope starting device. The recoil starter 19 has a reel 20, a rope 21 wound around the reel 20 and a knob 22 connected to the end of the rope 21.

Figure 5:
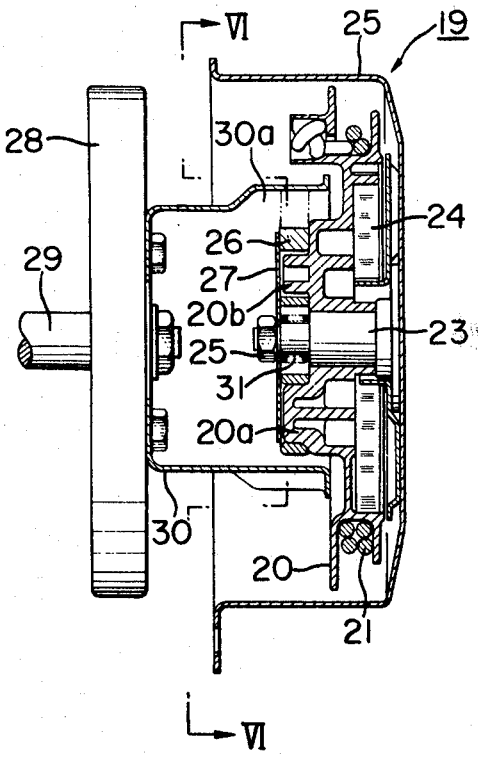
FIG. 5 is a vertical sectional view of an example of a recoil starter incorporated in the apparatus of the invention.

The construction of the recoil starter will be described in more detail with specific reference to FIG. 5, as well as FIGS. 6A and 6B.

A shaft 23 is attached to the inside of a cover case 25 fixed to the engine body. The aforementioned reel 20 is rotatably carried by this shaft 23. A coiled spring 24 coiled around the shaft 23 has one end fixed to the shaft 23, whereas the other end of the coiled spring 24 is connected to the reel 20. The aforementioned rope 21 having the aforementioned knob 22 to its one end is connected at its other end to this reel 20. The arrangement is such that the reel 20 rotates around the shaft 23 as the rope 21 is pulled by means of the knob 22 but is reversed by the resetting force of the coiled spring 24 to take up and wind the rope 21 again as the latter is released.

Two projections **20*a* and 20*b* are formed on one side of the reel 20 at both sides of the center of rotation. A claw 26 is rotatably supported by the projection 20*a*, as a center shaft. The claw 26 has two arcuate slots 26*a* and 26*b* which are adapted to receive the shaft 23 and the projection 20*b*, respectively. Therefore, the claw 26 can oscillate around the projection 20*a* while bieng guided by the projection 20*b*. The claw 26 is provided at a portion of outer periphery thereof with a hooked portion 26*c*, and is slightly pressed by means of a nut 25 and a plate 27 at the end of the shaft 23. The pressing force is adjustable by means of a spring 31**.

On the other hand, a pulley 30 is secured to a fly wheel 28 fixed to the engine crank shaft 29. The other end of this pulley 30 is extended to cover the outer periphery of the claw 26. A plurality of recesses **30*a* are formed in the inner peripheral surface of the pulley 30 at a portion of the latter corresponding to the claw 26**.

Figure 6A:
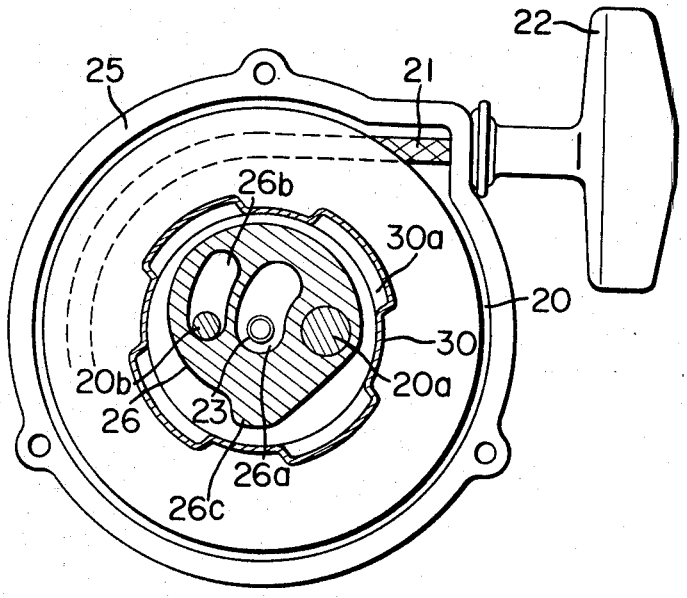
FIG. 6A is a sectional view taken along the line VI—VI of FIG. 5 and showing the knob in non-operating state.
Figure 6B:
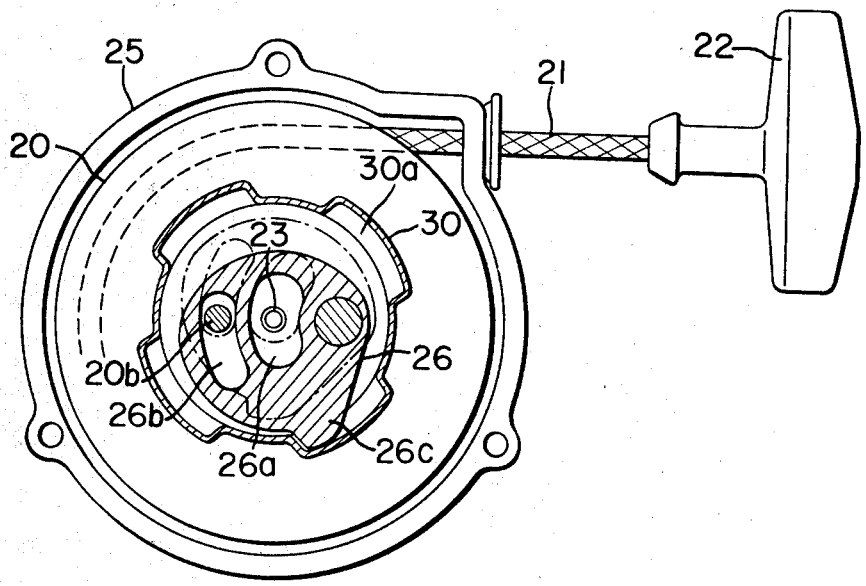
FIG. 6B is a sectional view similar to FIG. 6A but shows the knob in the pulled state.

In the above-described recoil starter, as the rope 21 is pulled out of the reel 20 by means of the knob 22, the claw 26 is swung outwardly around the projection **20*a* due to the centrifugal force from the state shown in FIG. 6A to the state shown in FIG. 6B, so that the hooked portion 26*c* of the claw 26 comes into engagement with the recess 30*a* of the pulley 30. As a result of this engagement, the pulley 30 is rotated to impart a torque to the crank shaft 29 through the fly wheel 28 thereby to start the engine. Then, as the engine is started, the hooked portion 26*c* of the claw 26 is pressed back toward the inside as shown by chain line in FIG. 6B by the inner peripheral surface of the pulley 30, because the latter rotates at a high speed after the start of the engine, so that the engagement between the hooked portion 26*c* and the recess 30*a* is dismissed. Then, as the knob 22 is released from the operator's hand, the reel 20 is reversed by the resetting torque of the coiled spring 24 to wind the rope 21** therearound.

The engine having the described decompression device and rope starting device in combination is started in a manner described hereinunder.

As the knob 22 of the recoil starter, i.e. the rope starting device, is pulled gently, the clutch is out into engagement to rotate the crank shaft 29. As the compression stroke is commenced, the resistance imparted to the rope is increased. The pulling of the rope 21 is suspended temporarily in this state.

Subsequently, the operation lever 17 of the decompression device is rotated counter-clockwise as shown in FIG. 2. In consequence, the cam 15 pushes the seat 12 upward to slightly open the exhaust valve 4 thereby to establish the state of decompression. The rope 21 is then set to the first position wound round the reel 20 and is then pulled strongly by means of the knob 22. The engine crank shaft 29 is rotated by this action. The first compression stroke is passed without substantial resistance, because the engine is kept in the state of decompression. Subsequently, the push rod 11 pushes the seat 9 of the valve lever 9 upward to bring the cam 15 out of engagement with the seat 12. Since the shaft 14 is rotatively biased in the clockwise direction as viewed in FIG. 1 by the spring 16, the cam 15 is automatically rotated as it is released from the seat 12 so that the state of decompression can no more be realized unless the operation lever 17 is operated. Namely, the decompression state of the engine is automatically dismissed.

Since the rope 21 is being pulled continuously in this state, the crank shaft is rotated further to start the second compression stroke. In this state, a sufficient inertia has been accumulated to rotate the crank shaft at a considerably high speed, so that the piston passes the top dead center for the second compression stroke which is, in this state, conducted without decompression, thereby to start the engine.

Thus, according to the invention, the previously achieved state of decompression is automatically dismissed during the pulling of the rope, in the exhaust stroke of the engine. It is therefore not necessary to make an additional manual operation for resetting the engine from the state of decompression to the state of normal operation in which the compression is made in due course. The setting of the decompression state made by the operation lever 17 is made when the pulling of the rope 21 is temporarily stopped, as stated before. It is therefore possible to operate the decompression device and the rope starting device by only one operator.

It will be clear to those skilled in the art that, in rotating the reel 20 by pulling the rope 21 of the recoil starter, a considerable reaction is imparted to the rope 21 when the piston moves beyond the top dead center for the second compression stroke, so that a shock is imparted to the arm of the operator.

This shock, however, can be diminished by adopting a special connecting construction between the knob 22 and the rope 21. FIGS. 7 to 14 show different examples of the connecting construction between the knob 22 and the rope 21 for diminishing the shock.

Figure 7A:
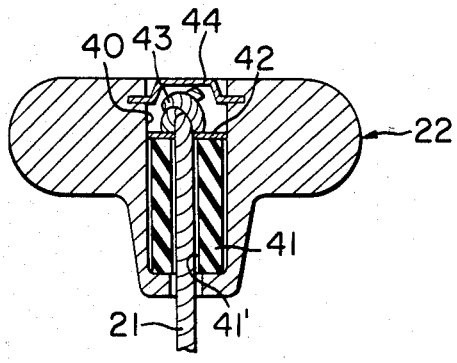
FIGS. 7A and 7B are vertical sectional views of the knob in the non-operating state and operating state, respectively.
Figure 7B:
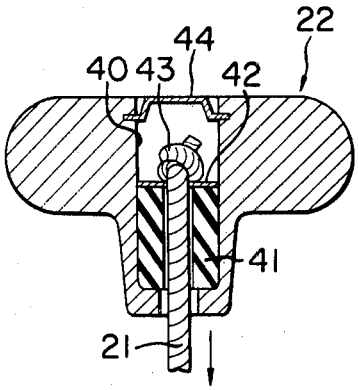

Referring to FIGS. 7A and 7B, a T-shaped body of the knob 22 is provided at its central part with a cylindrical bore 40 having a bottom receiving a cylindrical buffer 41 made of rubber and having a diameter slightly smaller than the diameter of the bore 40. The buffer 41 is provided with a concentric through bore 41' receiving the end of the rope 21. A knot 43 is formed out of a washer 42. Thus, the knob 22 is connected to the rope 21 through a medium of the buffer 41. A reference numeral 44 denotes a stopper. FIG. 7A shows the state before the pulling of the rope 21. As the rope 21 is pulled from this state, the cylindrical buffer 41 is compressed in the longitudinal direction thereof thereby to absorb and diminish the impact transmitted to the rope 21.

Figure 8A:
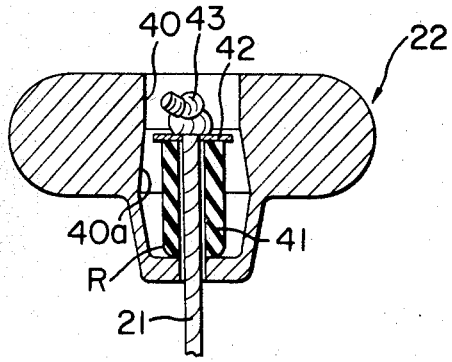
FIGS. 8A and 8B are vertical sectional views of another example of the knob in the non-operating state and operating state, respectively.
Figure 8B:
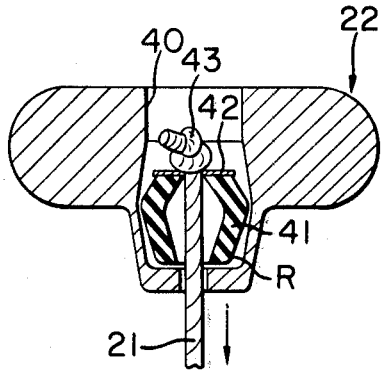

FIGS. 8A and 8B show a modification of the knob shown in FIGS. 7A and 7B. In this modification, the inside diameter of the bore 40 formed at the center of the knob 22 is selected to be sufficiently large as compared with the outside diameter of the cylindrical buffer 41 made of rubber. At the same time, the inner surface of the bore 40 is recessed as at **40*a* to expand radially outwardly at a portion thereof corresponding to the buffer 41**.

Further, the lower end corner of the cylindrical buffer member 41 is shaped to have an arcuate or curved surface R. Therefore, as the rope 21 is pulled from the position shown in FIG. 8A, the cylindrical buffer 41 is deflected at its central portion as shown in FIG. 8B and deformed to expand radially outwardly. The curved surface R at the lower end of the cylindrical buffer 41 is provided for facilitating this buckling.

Figure 9A:
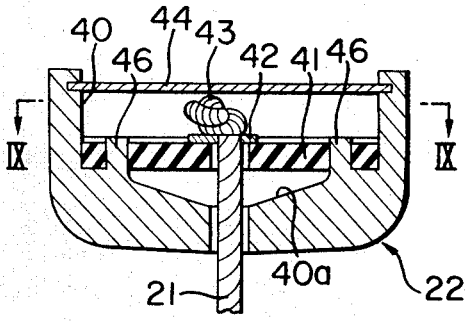
FIG. 9A is a vertical sectional view of still another example of the knob.
Figure 9B:
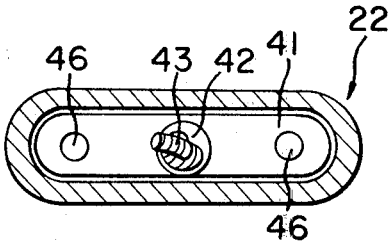
FIG. 9B is a sectional plan view taken along the line IX—IX of FIG. 9A.

FIGS. 9A and 9B show another example of the knob 22 in which the bore 40 of the knob 22 is made to have a groove-like form. A tabular buffer 45 made of rubber is retained in this groove-like bore 40 by means of projection 46. In order to preserve a sufficiently large space between the groove-like bore 40 and the tabular buffer 45, the bottom of the groove-like bore 40 is shaped to have a recess **40*a*. As the rope 21 is pulled by this knob 22, the tabular buffer 45 is deflected at its central part while both ends thereof being retained by the projections 46**, thereby to absorb and diminish the impact.

Figure 10A:
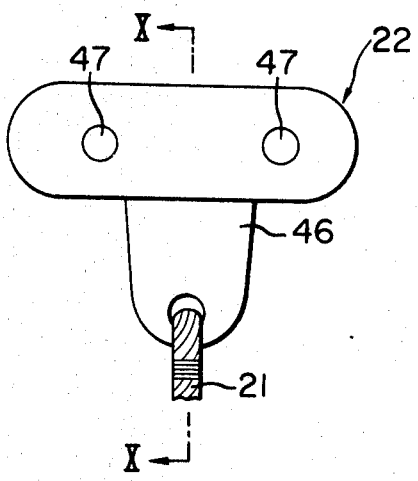
FIG. 10A is a front elevational view of a further example of the knob.
Figure 10B:
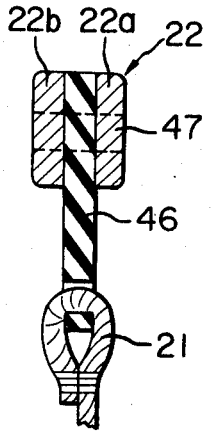
FIG. 10B is a sectional view taken along the line X—X of FIG. 10A.

FIGS. 10A and 10B show still another example in which the body of the knob 22 is composed of two plates **22*a* and 22*b* between which clamped is a tabular buffer 46 made of rubber. The tabular buffer 46 is fixed by means of pins 47. The rope 21 is connected to the lower end of this tabular buffer 46. Therefore, as the rope 21 is pulled by means of the knob 22, the tabular buffer 46** is extended to absorb and diminish the impact.

Figure 11:
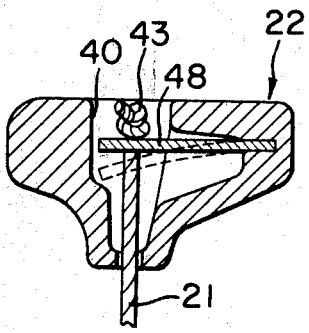
FIG. 11 is a sectional view of a still further example of the knob.

FIG. 11 show a further example in which a leaf spring 48 constituting the buffer is cantilevered in the bore 40 formed in the body of knob 22. The rope 21 is connected and secured to the free end of this buffer 48 by means of a knot 43.

Figure 12A:
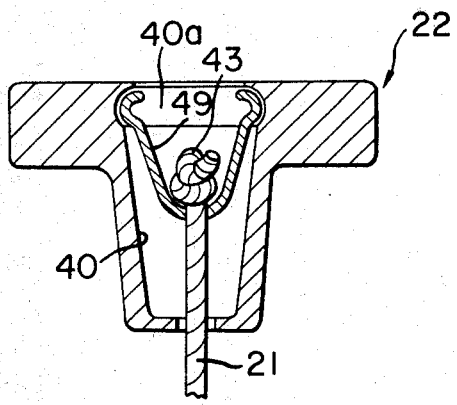
FIGS. 12A and 12B are vertical sectional views of a still further example of the knob in the non-operating and operating states, respectively.
Figure 12B:
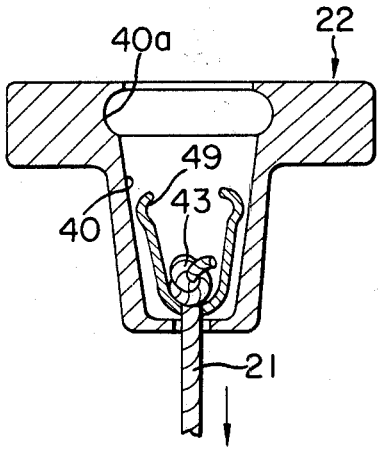

Referring now to FIGS. 12A and 12B showing a still further example of the knob, the bore 40 formed in the knob 22 is tapered such that the width thereof is gradually decreased toward the lower side. At the same time, a ring-shaped recess **40*a* is provided on the upper end of the bore 40. A deflected buffer 49 consisting of a bent leaf spring is received by the bore 40 such that it resiliently presses the inner surface of the bore 40. The rope 21 is connected to the central portion of this deflected buffer 49 by means of a knot 43. FIG. 12A shows the state before pulling the rope 21, in which the deflected buffer 49 is retained at its both ends by the recess 40*a* and the bore 40. As will be seen from FIG. 12B, the both ends of the deflected buffer 49 leave the recess 40*a* as the rope 21 is pulled and slide along the tapered wall of the bore thereby to absorb and diminish the impact. The deflected buffer 49 automatically climbs the tapered wall of the bore 40 to fit the recess 40*a*** again, thanks to its resiliency.

Figure 13:
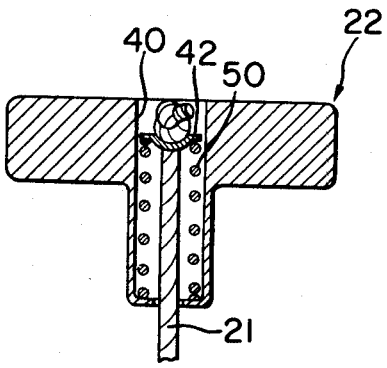
FIG. 13 is a vertical sectional view of still further example of the knob.

FIG. 13 shows a still further example of the knob in which the rubber buffer 41 of the example shown in FIGS. 7A and 7B is substituted by a buffer 50 made of a coiled spring.

Figure 14A:
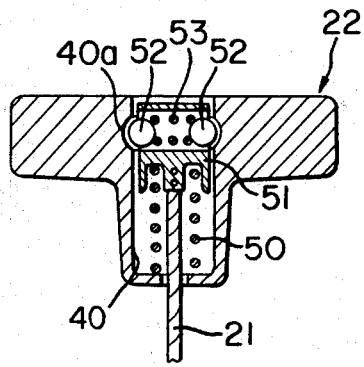
FIGS. 14A and 14B are longitudinal sectional views of a still further example of the knob in the non-operating and operating states, respectively.
Figure 14B:
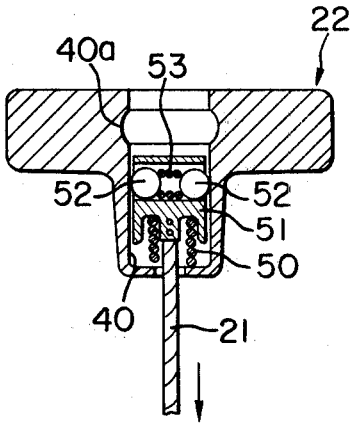

A still further example of the knob shown in FIGS. 14A and 14B is a modification of that shown in FIG. 13. In this example, a pair of balls 52 are received by retaining portion 51 provided at the end of the rope 21. These balls 52 are resiliently pressed against the inner surface of the bore **40*a* by means of the spring 53. Before the pulling of the rope 21, the pair of balls 52 fit the recess 40*a* of the bore 40 as shown in FIG. 14A to retain the retaining portion 51. However, as the rope 21 is pulled, the balls 52 are moved out from the recess 40*a* so that the retaining portion 51 is lowered absorbing and diminishing the impact transmitted to the rope 21. The starting condition shown in FIG. 14A is resumed as the knob 22** is released.

As has been described, according to the invention, the internal combusition engine equipped with both of a decompression device and a rope starting device can be started by only one operator, because the decompression device which is set beforehand is automatically dismissed during operation of the rope starting device. Further, the operator is protected against the large impact which takes place when the crank shaft is rotated beyond the top dead center for a compression stroke, thanks to the impact absorbing and diminishing mechanism provided in the knob attached to the rope.

The present invention is not, of course, limited to the above-described embodiments but may be modified in various ways within the scope of the appended claims.

What is claimed is:

1. An apparatus for starting an internal combustion engine, said engine including crankshaft rotatably mounted therein, an exhaust valve, and a valve actuating mechanism which comprises a valve spring biasing said exhaust valve to a closed position, a valve lever rockably mounted having two ends, and a push rod operatively coupled with said crankshaft and engaging one of said ends of said valve lever, the other end of said valve lever engaging and operating said exhaust valve, said apparatus comprising: a recoil starter including a rope provided with a knob associated therewith, a reel around which said rope is wound and a clutch adapted to transmit the rotation of said reel to the engine crank shaft; and a decompression device including a cam having a flat surface adapted to forcibly maintain the exhaust valve in an open position by pushing said one end of the valve lever, a rotatably mounted shaft on which said cam is fixed, and a shaft spring resiliently and rotatively biasing said shaft in a direction desengaging said cam from said valve lever, the amount of push of said one end of said valve lever by said cam being set to be smaller than that provided by the push rod of the valve actuating mechanism, said shaft spring being sized to exert a resilient force smaller than the valve spring of said valve actuating mechanism for said exhaust valve such that said cam is held in position by engagement of said flat surface with said valve lever, whereby, when said valve lever is pushed at its one end by said cam, said flat surface of said cam engages said valve lever keeping said exhaust valve in the opened state against the resilient force of said valve spring, whereas, when said push rod pushes said one end of said valve lever, said cam is rotated and automatically disengaged from said valve lever by the biasing action of said shaft spring.

2. An apparatus for starting an internal combustion engine as claimed in claim 1, wherein a seat is attached to said one end of said valve lever to be contacted by said flat surface of said cam, the position of said seat being adjustable by means of an adjusting screw.

3. An apparatus for starting an internal combustion engine as claimed in claim 2, wherein an operation lever is fixed to an end of said shaft carrying said cam.

4. An apparatus for starting an internal combustion engine as claimed in claim 1, characterized by further comprising a flywheel connected between said reel and said engine crank shaft, said clutch including a claw provided on said reel extractably and retractably, and a bore formed in a pully connected to said flywheel to be engaged by said claw, said claw being adapted to be extracted and brought into engagement with said bore as said rope is pulled to rotate said reel.

5. An apparatus for starting an internal combustion engine as claimed in claim 1, wherein said rope is connected at its one end to said knob through a medium of a buffer retained in a bore formed in a central portion of said knob.

6. An apparatus for starting an internal combustion engine as claimed in claim 5, wherein said buffer is a cylindrical member made of rubber having a central bore and retainer means on said member, an end portion of said rope being retained to said buffer by passing through said central bore and being held in said retainer means.

7. An apparatus for starting an internal combustion engine as claimed in claim 6, wherein said bore of said knob has an inside diameter larger than the outside diameter of said cylindrical rubber member and a portion of said cylindrical rubber member contactable with a bottom surface of said bore is shaped at a curvature.

8. An apparatus for starting an internal combustion engine as claimed in claim 5, wherein said buffer is a coil spring with a central bore and retainer means for holding said rope, an end portion of said rope being retained by passing through said central bore and being held in said retainer means.

9. An apparatus for starting an internal combustion engine as claimed in claim 8, wherein said retainer means for said rope is loaded with a plurality of balls, said balls being adapted to contact the wall of said bore of said knob and resiliently pressed against said wall, said wall having at least one recess for engagement with said balls.

10. An apparatus for starting an internal combustion engine as claimed in claim 5, wherein said buffer includes a leaf spring cantilevered on the wall of said bore of said knob, said rope being connected at its end portion to the free end of said leaf spring.

11. An apparatus for starting an internal combustion engine as claimed in claim 5, wherein the wall of said bore of said knob is tapered, and said buffer is a deflected leaf spring slidably received by said bore with its both ends resiliently abutting the surface of said wall, said rope being connected at its end portion to said deflected leaf spring.

* * * * *